US008875321B2

(12) United States Patent
Kanthasamy

(10) Patent No.: US 8,875,321 B2
(45) Date of Patent: Nov. 4, 2014

(54) MULTI-LEVEL SOFA HINGE FOR SOFA CONVERTIBLE

(75) Inventor: Abedan Kanthasamy, Kuala Lumpur (MY)

(73) Assignee: Lifestyle Solutions, Inc., Fremont, CA (US)

( * ) Notice: Subject to any disclaimer, the term of this patent is extended or adjusted under 35 U.S.C. 154(b) by 917 days.

(21) Appl. No.: 12/860,965

(22) Filed: Aug. 23, 2010

(65) Prior Publication Data

US 2012/0042448 A1 Feb. 23, 2012

(51) Int. Cl.
*A47C 17/17* (2006.01)

(52) U.S. Cl.
CPC ..... *A47C 17/17* (2013.01)
USPC ..... 5/37.1; 5/57.1; 297/354.12; 297/354.13

(58) Field of Classification Search
USPC ..... 5/12.1, 16, 37.1, 57.1; 16/324, 326, 16/344, 352; 297/354.12, 354.13
See application file for complete search history.

(56) References Cited

U.S. PATENT DOCUMENTS 2,601,683 A * 7/1952 Bebry et al. ..... 5/57.1
2,625,693 A * 1/1953 Raginsky ..... 5/57.1
2,679,892 A * 6/1954 Johnson ..... 297/359
2,682,917 A * 7/1954 Schultz ..... 297/367 R
2,859,798 A * 11/1958 Carte ..... 297/321
2,939,156 A * 6/1960 Fox ..... 5/37.1
3,913,152 A * 10/1975 Quakenbush ..... 5/37.1
4,318,568 A 3/1982 Ericsson
4,608,722 A * 9/1986 Zorzetto ..... 5/18.1
4,654,902 A * 4/1987 Shrock et al. ..... 5/37.1
5,146,640 A 9/1992 Barton et al.
5,153,952 A 10/1992 Barton et al.
6,209,154 B1 * 4/2001 Huang ..... 5/37.1
6,427,262 B1 * 8/2002 Huang ..... 5/37.1
6,651,274 B2 11/2003 Swihart et al.
2004/0034928 A1 * 2/2004 Patella ..... 5/13

* cited by examiner

*Primary Examiner* — Robert G Santos
*Assistant Examiner* — Ifeolu Adeboyejo
(74) *Attorney, Agent, or Firm* — Jackson Walker L.L.P.

(57) ABSTRACT

A sofa hinge that provides easy conversion of a sofa convertible from one position to another while providing added safety by substantially reducing the risk of an injury to the operator's fingers. The sofa hinge includes a first and a second bracket rotatably connected to the sofa hinge at a bolt. The second bracket includes a semi-circular portion that covers a portion of the lever during the various positions of the sofa. The sofa hinge further includes a cover plate rotatably connected to the sofa hinge at the bolt. The cover plate includes a semi-circular portion and is adjacent to the semi-circular portion of the second bracket. The cover plate covers at least a portion of the semi-circular portion of the second bracket. By having the cover plate conceal the gear mechanism of the sofa hinge, the risk of injury to the operator's fingers is substantially reduced.

22 Claims, 10 Drawing Sheets

MULTI-LEVEL SOFA HINGE FOR SOFA CONVERTIBLE

TECHNICAL FIELD

The present invention relates to sofas, and more particularly to a sofa hinge used for converting a sofa into multiple positions.

BACKGROUND OF THE INVENTION

This section provides background information to facilitate a better understanding of the various aspects of the present invention. It should be understood that the statements in this section of this document are to be read in this light, and not as admissions of prior art.

A sofa is an upholstered item of furniture for the comfortable seating of more than one person and typically has an armrest on both sides of the sofa along with a back rest. Sofas are usually to be found in the family room, living room, den or the lounge. They are covered in a variety of textiles or in leather.

Sofas may be designed to be convertible into different positions, such as a lounge position or a bed position in addition to the sofa position. A hinge, which connects the sofa seat with the back rest of the sofa, is used to mechanically allow the operator of the sofa to switch the sofa from one position to another. Often, a hinge is placed on each side of the sofa. Hinges that are used to convert a sofa into multiple positions may be referred to as a "click clack mechanism" due to the clicking sound that is made when the sofa is converted into a new position.

Currently, the design of these types of hinges includes an exposed gear mechanism which may potentially snap an operator's finger while the operator transitions the sofa from one position to another.

Therefore, there is a need in the art for a sofa hinge that provides easy conversion of the sofa from one position to another while providing added safety by substantially reducing the risk of an injury to the operator's fingers.

BRIEF SUMMARY OF THE INVENTION

In one embodiment of the present invention, a sofa hinge comprises a first bracket and a second bracket, where the second bracket comprises a semi-circular portion and where the first and second brackets are rotatably connected together via a first bolt. The sofa hinge further comprises a lever connected to the first bracket via a first lever latch on the first bracket. The lever is connected to the second bracket via a second lever latch on the second bracket. Additionally, the lever comprises a plurality of notches, where the first lever latch is bolted to an end of the lever and where the second lever latch comprises a pin used to select one of the plurality of notches of the lever to select a position of a sofa. In addition, the sofa hinge comprises a cover plate rotatably connected to the first bolt, where the cover plate comprises a semi-circular portion and where the cover plate covers at least a portion of the semi-circular portion of the second bracket in various positions of the sofa. Furthermore, the semi-circular portion of the second bracket covers a portion of the lever in various positions of the sofa.

In another embodiment of the present invention, a sofa comprises a sofa seat and a back rest. Furthermore, the sofa comprises a hinge rotatably connecting the sofa seat with the back rest. The sofa hinge comprises a first bracket and a second bracket, where the second bracket comprises a semi-circular portion and where the first and second brackets are rotatably connected together via a first bolt. The sofa hinge further comprises a lever connected to the first bracket via a first lever latch on the first bracket. The lever is connected to the second bracket via a second lever latch on the second bracket. Additionally, the lever comprises a plurality of notches, where the first lever latch is bolted to an end of the lever and where the second lever latch comprises a pin used to select one of the plurality of notches of the lever to select a position of the sofa. In addition, the sofa hinge comprises a cover plate rotatably connected to the first bolt, where the cover plate comprises a semi-circular portion and where the cover plate covers at least a portion of the semi-circular portion of the second bracket in various positions of the sofa. Furthermore, the semi-circular portion of the second bracket covers a portion of the lever in various positions of the sofa.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWING

A better understanding of the present invention can be obtained when the following detailed description is considered in conjunction with the following drawings, in which.

DETAILED DESCRIPTION OF THE INVENTION

The present invention comprises a sofa hinge that includes a first and a second bracket rotatably connected to the sofa hinge at a bolt. The second bracket includes a semi-circular portion that covers a portion of the lever during the various positions (e.g., lounge, sofa, sofa bed) of the sofa. The lever is bolted to the first and second brackets via a first and second lever latch on the first and second bracket, respectively. The second lever latch includes a pin which is used to select a particular notch of the lever to select a position of the sofa. The sofa hinge further includes a cover plate rotatably connected to the sofa hinge at the bolt. The cover plate includes a semi-circular portion and is adjacent to the semi-circular portion of the second bracket. The cover plate covers at least a portion of the semi-circular portion of the second bracket in various positions of the sofa. By having the cover plate conceal the gear mechanism of the sofa hinge, the risk of injury to the operator's fingers is substantially reduced.

It is to be understood that the following disclosure provides many different embodiments, or examples, for implementing different features of various embodiments. Specific examples of components and arrangements are described below to simplify the patent disclosure. These are, of course, merely examples and are not intended to be limiting.

As discussed in the Background section, currently, the design of click-clack mechanisms includes an exposed gear mechanism which may potentially snap an operator's finger while the operator transitions the sofa from one position to another. Therefore, there is a need in the art for a sofa hinge that provides easy conversion of the sofa from one position to another while providing added safety by substantially reducing the risk of an injury to the operator's fingers.

Figure 1:
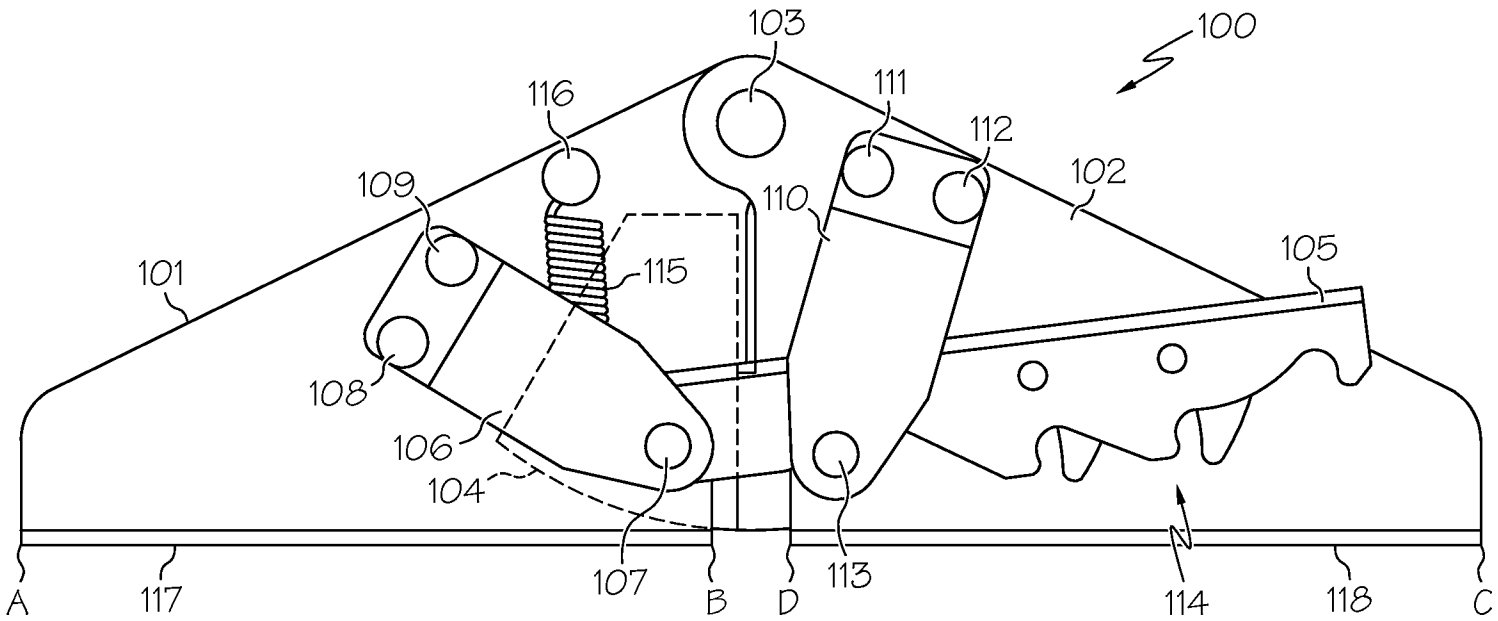
FIG. 1 is an elevation view of a multi-level sofa hinge for a sofa convertible in accordance with an embodiment of the present invention.
Figure 2:
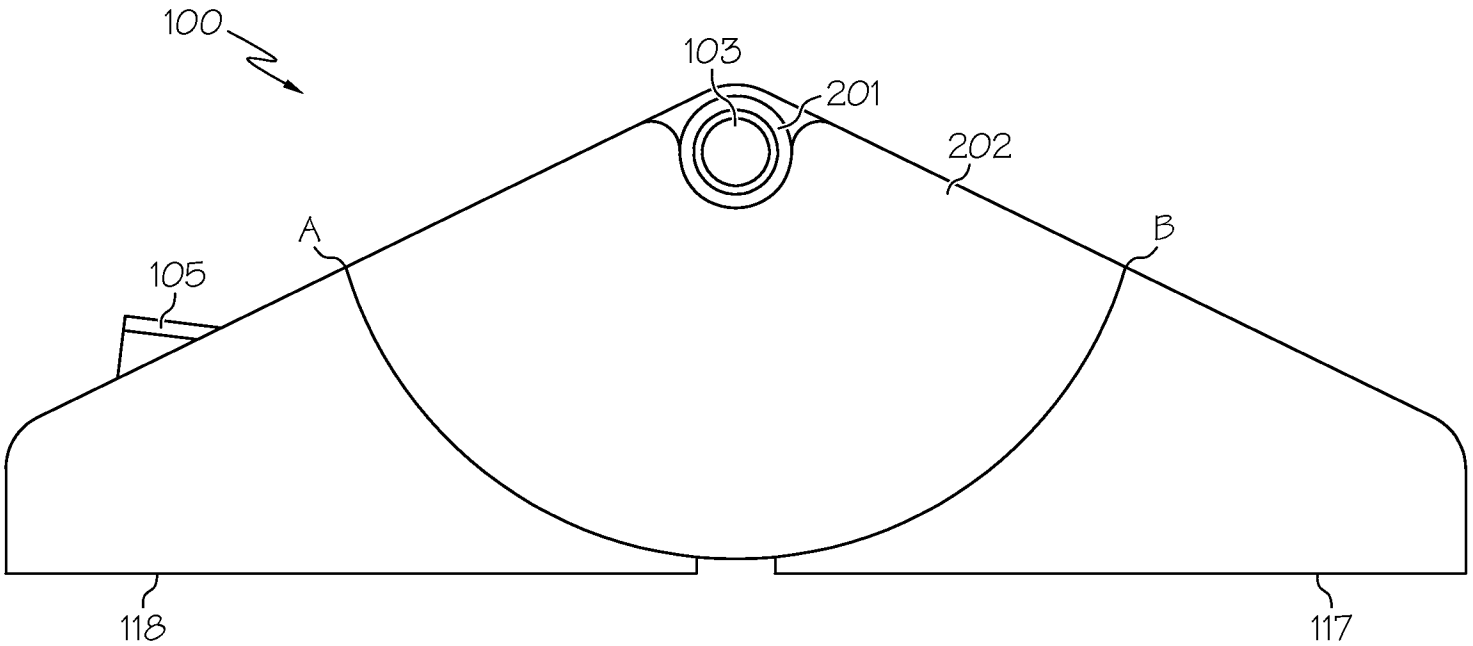
FIG. 2 illustrates an external view of the multi-level sofa hinge for a sofa convertible in accordance with an embodiment of the present invention.
Figure 3A:
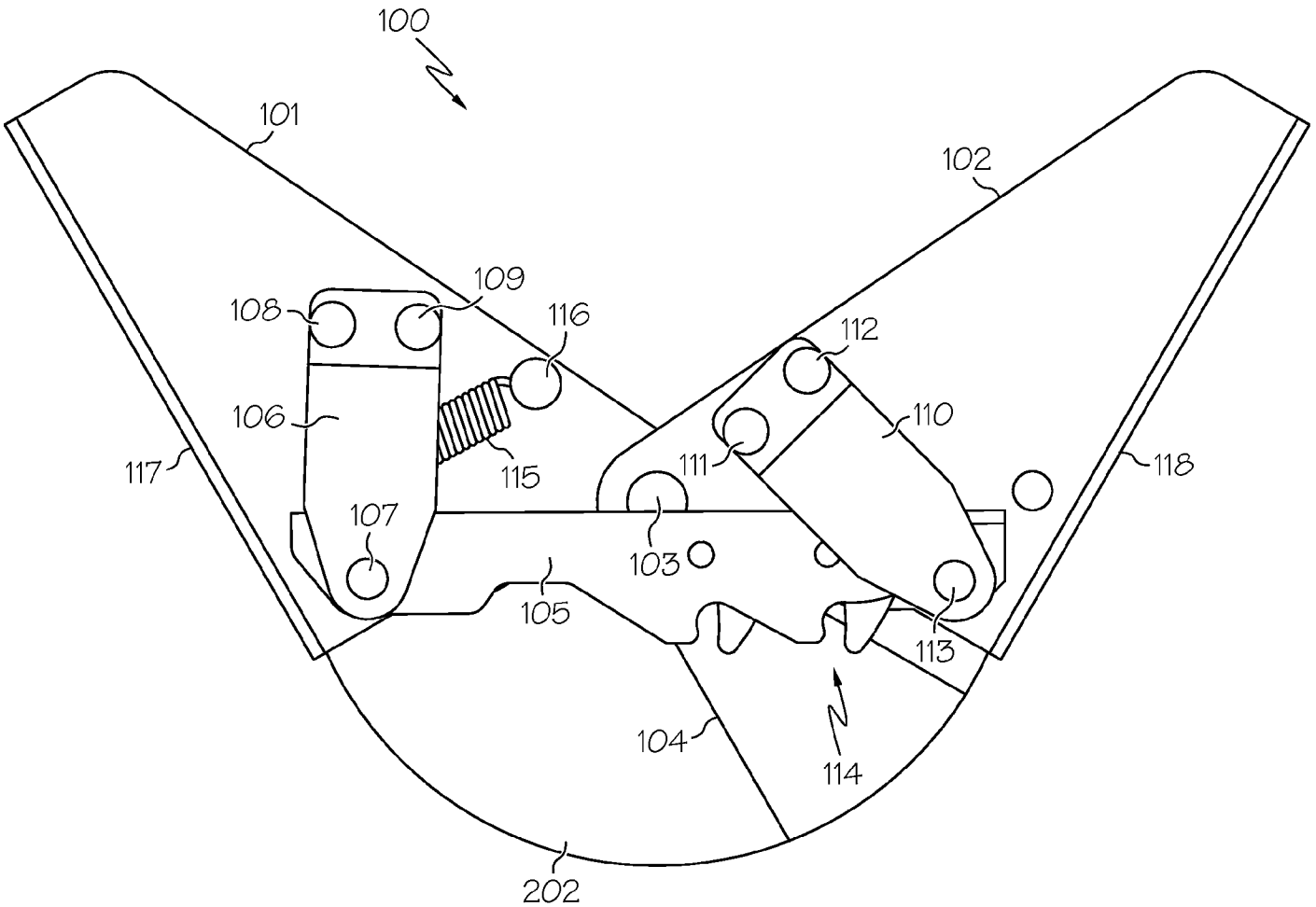
FIGS. 3A-3B illustrate a sofa hinge a sofa according to one or more aspects of the present invention in a released, or unlocked, position permitting the first bracket and second bracket, and therefore the back and seat platforms of the sofa, to move relative to one another.
Figure 3B:
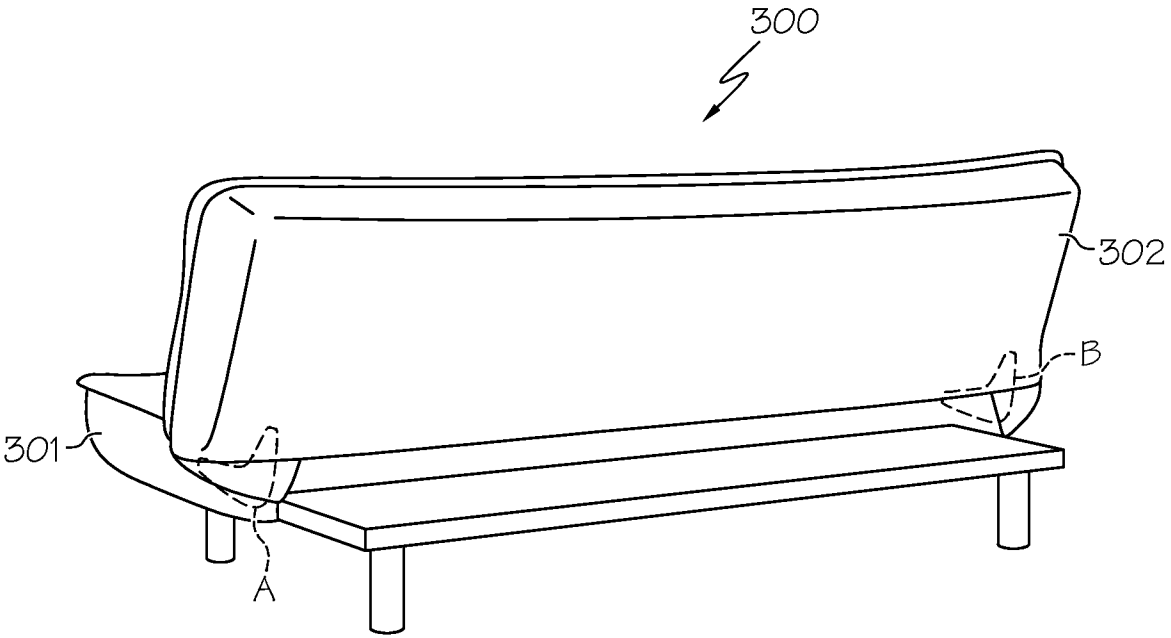
Figure 4A:
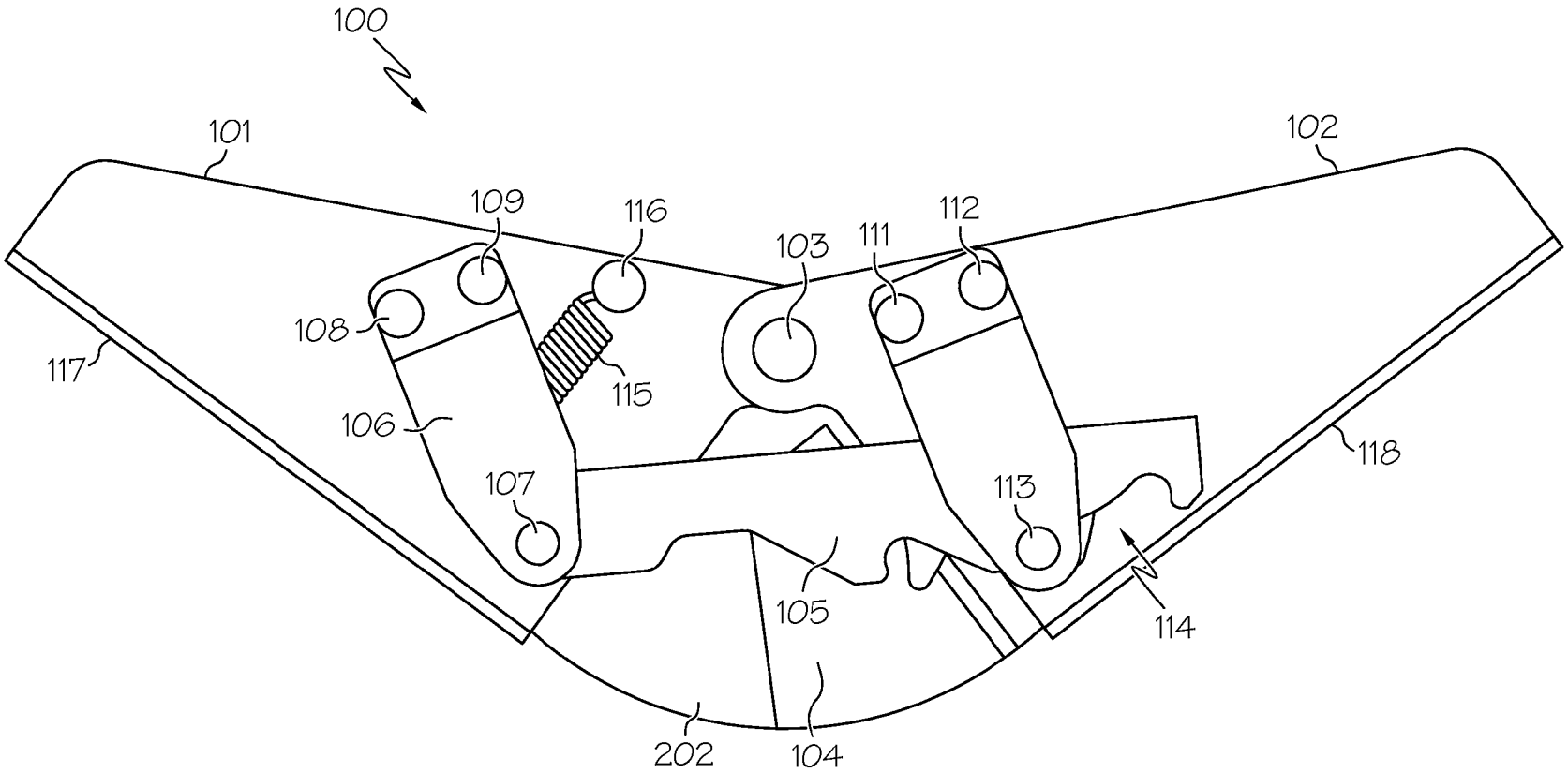
FIGS. 4A-4B illustrate a sofa hinge and a sofa secured in a sofa position in accordance with an embodiment of the present invention.
Figure 4B:
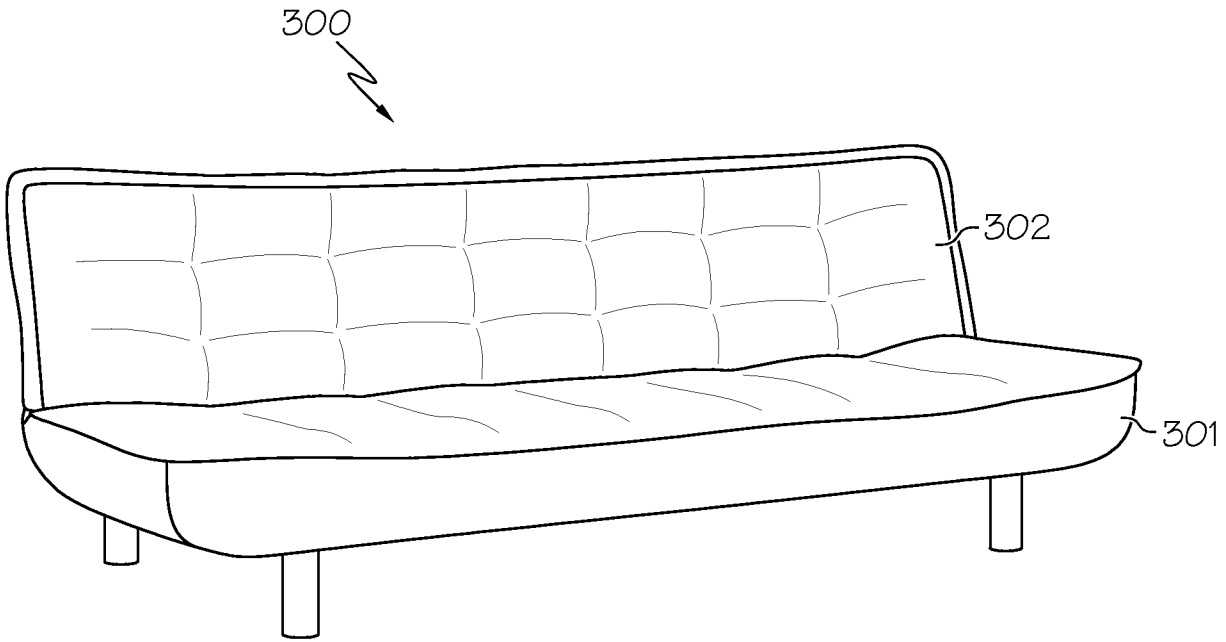
Figure 5A:
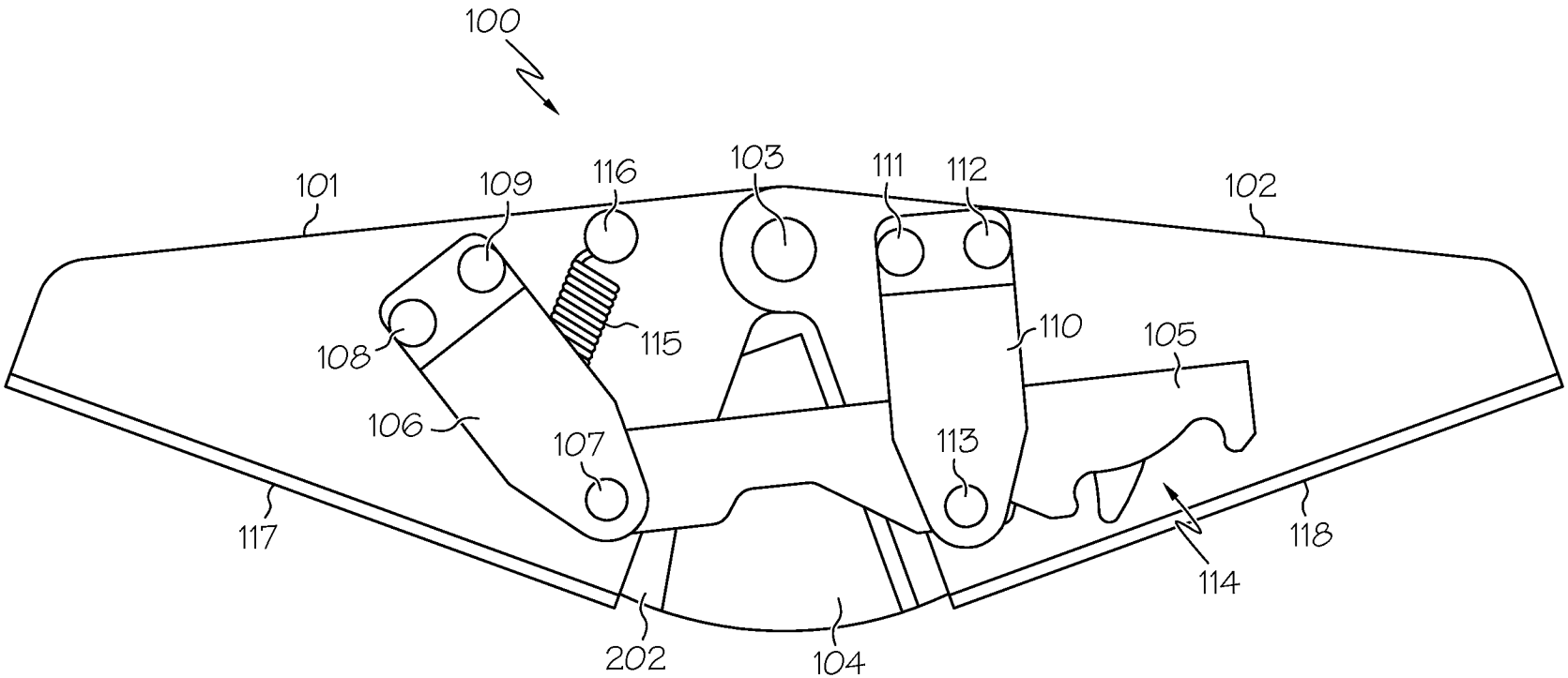
FIGS. 5A-5B illustrate a sofa hinge and a sofa secured in a lounge position in accordance with an embodiment of the present invention.
Figure 5B:
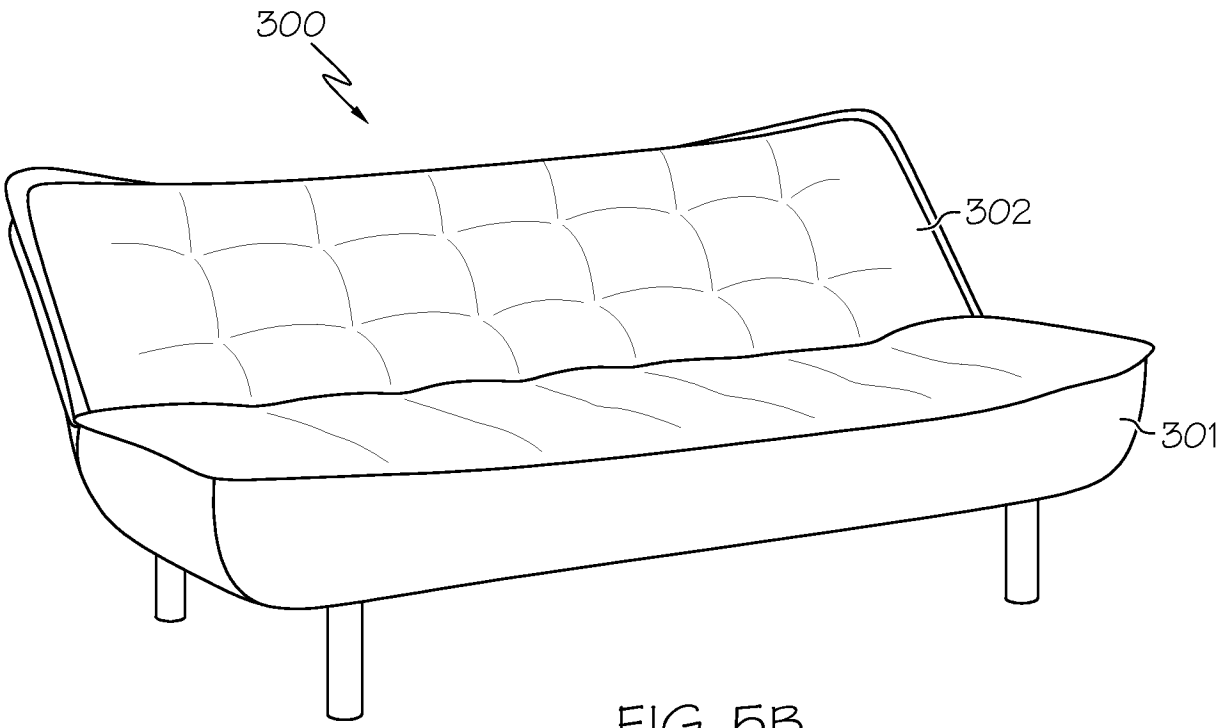
Figure 6A:
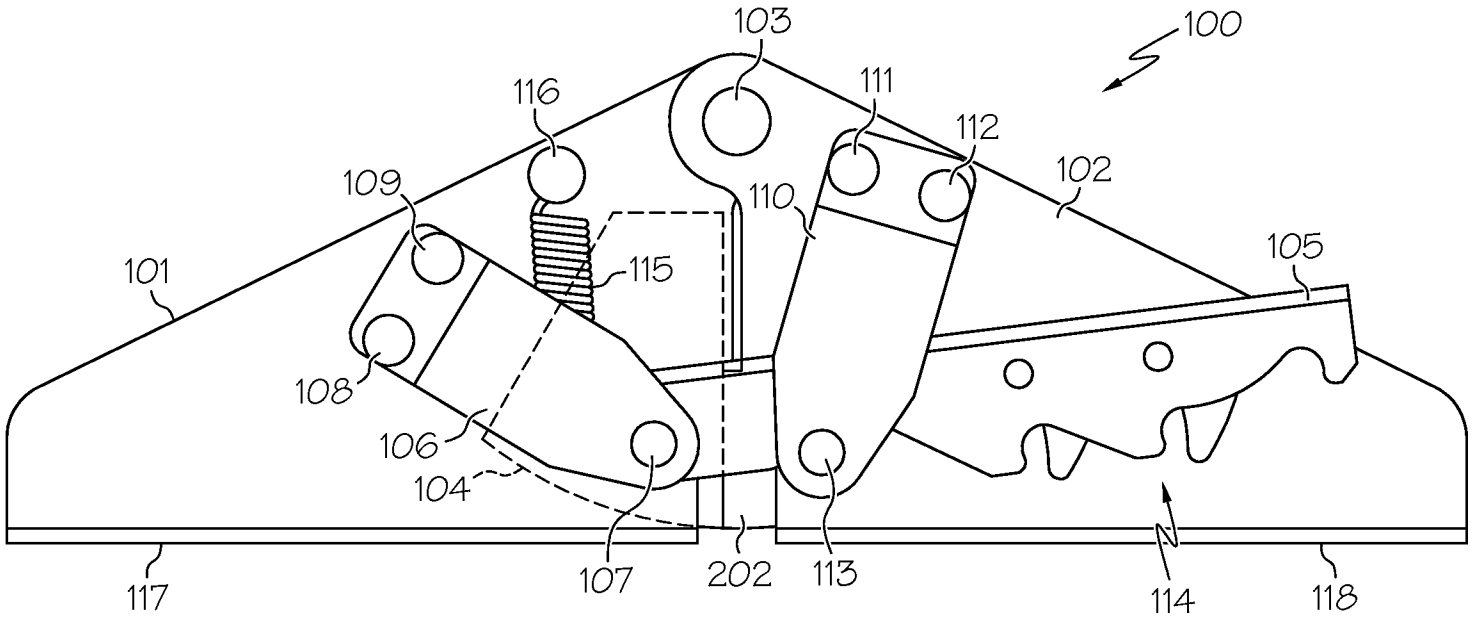
FIGS. 6A-6B illustrate a sofa hinge and a sofa secured in a sofa bed position in accordance with an embodiment of the present invention.
Figure 6B:
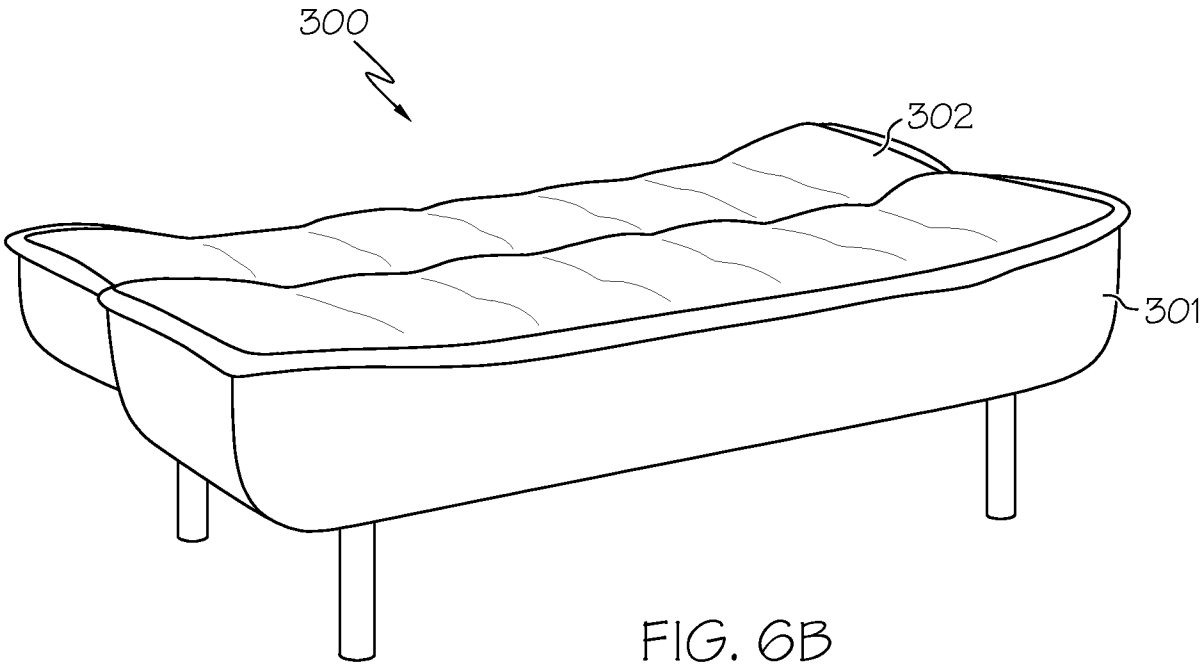

The sofa hinge of the present invention provides easy conversion of a sofa convertible from one position to another while providing added safety by substantially reducing the risk of injury to the operator's fingers as discussed below in connection with FIGS. 1-2, 3A-3B, 4A-4B, 5A-5B and 6A-6B. FIG. 1 is an internal view of the sofa hinge, which may also be referred to as a "click-clack mechanism." FIG. 2 illustrates an external view of the sofa hinge. FIGS. 3A-3B illustrate a sofa hinge and a sofa when the sofa is secured in the release position. FIGS. 4A-4B illustrate the sofa hinge and sofa when the sofa is secured in the sofa position. FIGS. 5A-5B illustrate the sofa hinge and sofa when the sofa is secured in the lounge position. FIGS. 6A-6B illustrate the sofa hinge and sofa when the sofa is secured in the sofa bed position.

Referring to FIG. 1, FIG. 1 is an internal view of a sofa hinge 100 in accordance with an embodiment of the preset invention. Sofa hinge 100 includes brackets 101, 102 which are rotatably connected together via a bolt 103. Bracket 102 further includes a semi-circular portion 104 which covers a portion of lever 105 (from an external perspective as shown in FIG. 2) during the various positions (e.g., lounge, sofa, sofa bed) of the sofa.

Sofa hinge 100 further includes lever 105 which is connected to bracket 101 via a lever latch 106. In particular, lever latch 106 is bolted to lever 105 at one end of lever 105 at bolt 107. Lever latch 106 may be bolted to bracket 101 via bolts 108, 109.

Lever 105 is connected to bracket 102 via a lever latch 110. Lever latch 110 may be bolted to bracket 102 via bolts 111, 112. Furthermore, lever latch 110 includes a pin 113 used to select one of the notches 114 of lever 105 to select a position of the sofa. As pin 113 selects a particular notch 114 of lever 105, a "clicking" sound is heard which provides an indication to the operator that a new position of the sofa (e.g., lounge, sofa, sofa bed) has been established.

Additionally, sofa hinge 100 may include a spring 115 connected to an end of lever 105 where spring 115 is bolted to bracket 101 via bolt 116.

In one embodiment, the distance of bracket 101 from the end identified as "A" in FIG. 1 to bolt 113 is about 5½ inches in length. In one embodiment, bracket 101 includes a flap 117 extending from the end labeled as "A" in FIG. 1 to the end labeled as "B" in FIG. 1. In one embodiment, the distance of flap 117 from end A to end B is about 4¾ inches in length.

In one embodiment, the distance of lever 105 from bolt 107 to the opposite end of lever 105 is about 5 inches in length.

In one embodiment, the distance of bracket 102 from the end identified as "C" in FIG. 1 to bolt 113 is about 5½ inches in length. In one embodiment, bracket 102 includes a flap 118 extending from the end labeled as "C" in FIG. 1 to the end labeled as "D" in FIG. 1. In one embodiment, the distance of flap 118 from end C to end D is about 4¾ inches in length.

A description of the external view of sofa hinge 100 is provided below in connection with FIG. 2.

Referring to FIG. 2, in conjunction with FIG. 1, FIG. 2 illustrates an external view of sofa hinge 100 in accordance with an embodiment of the present invention. Components of sofa hinge 100 that are shown on both the internal (FIG. 1) and external (FIG. 2) views have the same identification number.

As illustrated in FIG. 2, sofa hinge 100 includes a cover plate 201 that includes a semi-circular portion 202. Cover plate 201 is rotatably connected to sofa hinge 100 via bolt 103. In one embodiment, cover plate 201 covers at least a portion of semi-circular portion 104 of bracket 102 in various positions of the sofa. By having cover plate 201 conceal the gear mechanism of sofa hinge 100, the risk of injury to the operator's fingers is substantially reduced.

In one embodiment, cover plate 201 is adjacent to semi-circular portion 104 of bracket 102. In one embodiment, the horizontal distance between the end labeled as "A" in FIG. 2 to the end labeled as "B" in FIG. 2 is about 5½ inches in length.

A description of the various configurations of sofa hinge 100 during the different positions of the sofa is described below in connection with FIGS. 3A-B, 4A-B, 5A-B and 6A-B.

Referring to FIG. 3A, in conjunction with FIGS. 1 and 2, FIG. 3A illustrates the configuration of sofa hinge 100 when the sofa (shown in FIG. 3B) is in the release position in accordance with an embodiment of the present invention. As illustrated in FIG. 3A, semi-circular portion 202 of cover plate 201 provides protection of an operator's fingers from the gear mechanism of sofa hinge 100.

Referring to FIG. 3B, FIG. 3B illustrates a sofa 300 when in the release position in accordance with an embodiment of the present invention. As illustrated in FIG. 3B, sofa hinge 100 may rotatably connect a sofa seat 301 with a back rest 302 residing in areas labeled as "A" and "B" in FIG. 3B.

Referring to FIGS. 4A-B, in conjunction with FIGS. 1 and 2, FIG. 4A illustrates the configuration of sofa hinge 100 when sofa 300 is in the sofa position as illustrated in FIG. 4B in accordance with an embodiment of the present invention. As illustrated in FIG. 4A, semi-circular portion 202 of cover plate 201 provides protection of an operator's fingers from the gear mechanism of sofa hinge 100.

Referring to FIGS. 5A-B, in conjunction with FIGS. 1 and 2, FIG. 5A illustrates the configuration of sofa hinge 100 when sofa 300 is in the lounge position as illustrated in FIG. 5B in accordance with an embodiment of the present invention.

Referring to FIGS. 6A-B, in conjunction with FIGS. 1 and 2, FIG. 6A illustrates the configuration of sofa hinge 100 when sofa 300 is in the sofa bed position as illustrated in FIG. 6B in accordance with an embodiment of the present invention.

Although the sofa and sofa hinge are described in connection with several embodiments, it is not intended to be limited to the specific forms set forth herein, but on the contrary, it is intended to cover such alternatives, modifications and equivalents, as can be reasonably included within the spirit and scope of the invention as defined by the appended claims.

The invention claimed is:

1. A sofa-bed hinge, comprising:

a first bracket having a first edge side;

a second bracket having a first edge side, wherein said second bracket is integrally formed with a first cover plate section, and wherein said first and second brackets are rotatably connected together via a first bolt;

a lever connected to an inside surface of said first bracket via a first lever latch on said first bracket, wherein said lever is connected to an inside surface of said second bracket via a second lever latch on said second bracket, wherein said lever comprises a plurality of notches, wherein said first lever latch is bolted to an end of said lever, wherein said second lever latch comprises a pin used to select one of said plurality of notches of said lever to select a position of a sofa-bed, wherein said first edge sides of said first and second brackets abut when said lever is in a bed position, wherein said first cover plate section covers a portion of said first bracket and said lever when said lever is in said bed position, and wherein as said lever changes from said bed position to a sofa position, said first bracket moves away from said second bracket, thereby creating a space between said first edge sides of said brackets and causing said lever to be exposed; and a second cover plate affixed to an outside surface of said first bracket, and rotatably connected to said second bracket via said first bolt, wherein when said second bracket rotates away from said first bracket, said second cover plate remains stationary, and wherein said first cover plate section, said second cover plate, and said first edge side of said first bracket lie in different vertical planes.

2. The sofa-bed hinge as recited in claim 1 further comprising: a spring connected to said end of said lever, wherein said spring is bolted to said first bracket.

3. The sofa-bed hinge as recited in claim 1, wherein a distance from a first end of said first bracket to said first bolt is about 5½ inches in length.

4. The sofa-bed hinge as recited in claim 3, wherein said first bracket comprises a first flap extending from said first end to a second end of said first bracket, wherein a length of said first flap is about 4¾ inches.

5. The sofa-bed hinge as recited in claim 4, wherein said first lever latch is bolted to said end of said lever at a second bolt, wherein a distance of said lever from said second bolt to an opposite end of said lever is about 5 inches in length.

6. The sofa-bed hinge as recited in claim 1, wherein a distance from a first end of said second bracket to said first bolt is about 5½ inches in length.

7. The sofa-bed hinge as recited in claim 6, wherein said second bracket comprises a second flap extending from said first end to a second end of said second bracket, wherein a length of said second flap is about 4¾ inches.

8. The sofa-bed hinge as recited in claim 1, wherein a horizontal distance from a first end to a second end of said semi-circular portion of said cover plate is about 5½ inches in length.

9. The sofa-bed hinge as recited in claim 1, wherein said positions of said sofa-bed comprise a release position, said sofa position, a lounge position and said bed position.

10. A sofa-bed, comprising:

a sofa seat;

a back rest;

a sofa-bed hinge rotatably connecting said sofa seat with said back rest, wherein said sofa-bed hinge comprises:

a first bracket having a first edge side;

a second bracket having a first edge side, wherein said second bracket is integrally formed with a first cover plate section, and wherein said first and second brackets are rotatably connected together via a first bolt;

a lever connected to an inside surface of said first bracket via a first lever latch on said first bracket, wherein said lever is connected to an inside surface of said second bracket via a second lever latch on said second bracket, wherein said lever comprises a plurality of notches, wherein said first lever latch is bolted to an end of said lever, wherein said second lever latch comprises a pin used to select one of said plurality of notches of said lever to select a position of said sofa-bed, wherein said first edge sides of said first and second brackets abut when said lever is in a bed position, wherein said first cover plate section covers a portion of said first bracket and said lever when said lever is in said bed position, and wherein as said lever changes from said bed position to a sofa position, said first bracket moves away from said second bracket, thereby creating a space between said first edge sides of said brackets and causing said lever to be exposed;

and a second cover plate affixed to an outside surface of said first bracket and rotatably connected to said second bracket via said first bolt, and wherein when said second bracket rotates away from said first bracket, said second cover plate remains stationary, and wherein said first cover plate section, said second cover plate, and said first edge side of said first bracket lie in different vertical planes.

11. The sofa-bed as recited in claim 10, wherein said sofa-bed hinge further comprises a spring connected to said end of said lever, wherein said spring is bolted to said first bracket.

12. The sofa-bed as recited in claim 10, wherein said positions of said sofa-bed comprise a release position, said sofa position, a lounge position and said bed position.

13. The sofa-bed hinge as recited in claim 1, wherein said second cover plate is semi-circular in shape and has a center point, wherein said second cover plate is connected to said first bracket, via said first bolt, in close proximity to said center point.

14. The sofa-bed hinge as recited in claim 1, wherein said second bracket is integrally formed with said first cover plate section by affixing said section to a surface of said second bracket in close proximity to said first edge side of said second bracket.

15. The sofa-bed hinge as recited in claim 14, wherein said first cover plate section is semi-circular in shape.

16. The sofa-bed hinge as recited in claim 15, wherein said first and second cover plates together form a semi-circular shape when said lever changes from said bed position to said release position.

17. The sofa-bed as recited in claim 10, wherein said second cover plate of said sofa-bed hinge is semi-circular in shape and has a center point, wherein said second cover plate is connected to said first bracket, via said first bolt, in close proximity to said center point.

18. The sofa-bed as recited in claim 10, wherein said second bracket is integrally formed with said first cover plate section by affixing said section to a surface of said second bracket in close proximity to said first edge side of said second bracket.

19. The sofa-bed as recited in claim 18, wherein said first cover plate section is semi-circular in shape.

20. The sofa-bed as recited in claim 19, wherein said first and second cover plates together form a semi-circular shape when said sofa-bed changes from said bed position to said release position.

21. The sofa-bed hinge as recited in claim 1, wherein said second cover plate covers a portion of said second bracket and said lever when said lever is in said bed position.

22. The sofa-bed as recited in claim 10, wherein said second cover plate covers a portion of said second bracket and said lever when said lever is in said bed position.

* * * * *

UNITED STATES PATENT AND TRADEMARK OFFICE

CERTIFICATE OF CORRECTION

PATENT NO. : 8,875,321 B2
APPLICATION NO. : 12/860965
DATED : November 4, 2014
INVENTOR(S) : Abedan Kanthasamy It is certified that error appears in the above-identified patent and that said Letters Patent is hereby corrected as shown below:

In the Claims

Please rearrange, amend, and/or renumber claims 10-22 as follows:

Column 5 line 60 - Column 7, line 6 delete claims 10-22 and substitute therefore with the following claims 10-22

[13] 10. The sofa-bed hinge as recited in claim 1, wherein said second cover plate is semi-circular in shape and has a center point, wherein said second cover plate is connected to said first bracket, via said first bolt, in close proximity to said center point.

[14] 11. The sofa-bed hinge as recited in claim 1, wherein said second bracket is integrally formed with said first cover plate section by affixing said section to a surface of said second bracket in close proximity to said first edge side of said second bracket.

[21] 12. The sofa-bed hinge as recited in claim 1, wherein said second cover plate covers a portion of said second bracket and said lever when said lever is in said bed position.

[10] 13. A sofa-bed, comprising:

a sofa seat;

a back rest;

a sofa-bed hinge rotatably connecting said sofa seat with said back rest, wherein said sofa-bed hinge comprises:

Signed and Sealed this
Fifteenth Day of December, 2015

Michelle K. Lee

Michelle K. Lee
*Director of the United States Patent and Trademark Office* a first bracket having a first edge side;

a second bracket having a first edge side, wherein said second bracket is integrally formed with a first cover plate section, and wherein said first and second brackets are rotatably connected together via a first bolt;

a lever connected to an inside surface of said first bracket via a first lever latch on said first bracket, wherein said lever is connected to an inside surface of said second bracket via a second lever latch on said second bracket, wherein said lever comprises a plurality of notches, wherein said first lever latch is bolted to an end of said lever, wherein said second lever latch comprises a pin used to select one of said plurality of notches of said lever to select a position of said sofa-bed, wherein said first edge sides of said first and second brackets abut when said lever is in a bed position, wherein said first cover plate section covers a portion of said first bracket and said lever when said lever is in said bed position, and wherein as said lever changes from said bed position to a sofa position, said first bracket moves away from said second bracket, thereby creating a space between said first edge sides of said brackets and causing said lever to be exposed;

and a second cover plate affixed to an outside surface of said first bracket and rotatably connected to said second bracket via said first bolt, and wherein when said second bracket rotates away from said first bracket, said second cover plate remains stationary, and wherein said first cover plate section, said second cover plate, and said first edge side of said first bracket lie in different vertical planes.

[11] <u>14</u>. The sofa-bed as recited in claim [10] <u>13</u>, wherein said sofa-bed hinge further comprises a spring connected to said end of said lever, wherein said spring is bolted to said first bracket.

[12] <u>15</u>. The sofa-bed as recited in claim [10] <u>13</u>, wherein said positions of said sofa-bed comprise a release position, said sofa position, a lounge position and said bed position.

[15] <u>16</u>. The sofa-bed hinge as recited in claim [14] <u>15</u>, wherein said first cover plate section is semi-circular in shape.

[16] <u>17</u>. The sofa-bed hinge as recited in claim [15] <u>16</u>, wherein said first and second cover plates together form a semi-circular shape when said lever changes from said bed position to said release position.

[17] 18. The sofa-bed as recited in claim [10] 13, wherein said second cover plate of said sofa-bed hinge is semi-circular in shape and has a center point, wherein said second cover plate is connected to said first bracket, via said first bolt, in close proximity to said center point.

[18] 19. The sofa-bed as recited in claim [10] 13, wherein said second bracket is integrally formed with said first cover plate section by affixing said section to a surface of said second bracket in close proximity to said first edge side of said second bracket.

[19] 20. The sofa-bed as recited in claim [18] 19, wherein said first cover plate section is semicircular in shape.

[20] 21. The sofa-bed as recited in claim [19] 20, wherein said first and second cover plates together form a semi-circular shape when said sofa-bed changes from said bed position to said release position.

22. The sofa-bed as recited in claim [10] 13, wherein said second cover plate covers a portion of said second bracket and said lever when said lever is in said bed position.